United States Patent [19]

Nishikawa

[11] Patent Number: 4,688,013

[45] Date of Patent: Aug. 18, 1987

[54] SWITCHGEAR ASSEMBLY FOR ELECTRICAL APPARATUS

[75] Inventor: Akira Nishikawa, Amagasaki, Japan

[73] Assignee: Mitsubishi Denki Kabushiki Kaisha, Japan

[21] Appl. No.: 860,588

[22] Filed: May 7, 1986

[30] Foreign Application Priority Data

May 9, 1985 [JP] Japan ..... 60-96701
Jun. 3, 1985 [JP] Japan ..... 60-118858

[51] Int. Cl.[4] ..... H01H 71/10
[52] U.S. Cl. ..... 337/168; 200/48 R; 200/49
[58] Field of Search ..... 337/167, 168, 169, 170, 337/171, 172, 173, 174, 175, 176, 177, 178, 179, 180, 181; 200/48, 49

[56] References Cited

U.S. PATENT DOCUMENTS 2,551,841 5/1951 Kepple et al. ..... 200/48

FOREIGN PATENT DOCUMENTS 55-14605 4/1980 Japan .

OTHER PUBLICATIONS

Descriptive Bulletin, 212-30, "S & C Power Fuses . . . ", S & C Electric Company, Mar. 1979.

*Primary Examiner*—Harold Broome
*Attorney, Agent, or Firm*—Leydig, Voit & Mayer

[57] ABSTRACT

A switchgear assembly for an electrical apparatus capable of improving operability thereof to a practical extent, as well as reducing not only installation area or space for various devices to be disposed below the switchgear but also the weight of the switchgear itself. The switchgear assembly such as a disconnecting switch assembly, fuse assembly or the like is interposed between a bus bar supported through a first support insulator on the top end of a vertical pole, and an electrical apparatus connected to the bus bar. The disconnecting switch assembly or fuse assembly comprises a movable contact pivoted at its one (lower) end to a pole mounted second support insulator for rotary motion in a vertical plane and engageable at the other (upper) end directly with the bus bar or with a fixed contact or fuse retainer supported on the bus bar by a fastening member. The other (upper) end of the movable contact or fuse is fastened to the bus bar completely independent of the pole. The movable contact may be a fuse with retainers at opposite ends.

9 Claims, 6 Drawing Figures

SWITCHGEAR ASSEMBLY FOR ELECTRICAL APPARATUS

BACKGROUND OF THE INVENTION

1. Field of the Invention

The present invention relates generally to a switchgear assembly for an electrical apparatus, and more particularly, to a switchgear assembly such as a disconnecting switch assembly, a fuse assembly and the like for opening and closing an electrical circuit connecting between a power source and an electrical load such as an electrical machine or apparatus.

2. Description of the Prior Art

In general, in order to disconnect an electrical machine or apparatus from a power source as required, a switchgear assembly is provided between the electrical machine or apparatus and the power source. FIG. 5 shows an example of the construction and arrangement of such a conventional switchgear assembly. In FIG. 5, fixedly mounted on a base 1 is a vertical pole 2 on the top of which a bus bar 4 of copper wires is supported through a support insulator 3. The bus bar 4 is attached to the support insulator 3 by means of a fastening member 3*a* at right angles relative to the support insulator 3 and the pole 2. Provided on the upper portion of the pole 2 is a switchgear in the from of a disconnecting switch assembly, generally designated at reference numeral 5, which includes a pair of support insulators 7 and 9 disposed horizontally in vertically spaced parallel relation with each other and fixedly mounted at their base end through a common support member 10 on the pole 2. The upper support insulator 7 has a fixed contact 6 attached to the distal end thereof, and the lower support insulator 9 has a support terminal 8 firmly secured to the distal end thereof with a movable contact 11 pivotally mounted at its lower end as at 11b on the support terminal 8 for rotary movement on a vertical plane. The movable contact 11 is integrally formed near the upper end thereof with an engagement eye 11*a* and is adapted to be engageable at its upper end with the fixed contact 6, the vertical distance between the upper and lower support insulators 7 and 9 and the length of the movable contact 11 being determined such that the upper end of the movable contact 11 can engage the fixed contact 6 at its vertical or upright position as illustrated by the solid outline of the movable contact 11 in FIG. 5. Thus, the disconnecting switch 5 is fixedly mounted through the support member 10 on the pole 2 with the upper support insulator 7 being disposed substantially at right angles relative to the vertically disposed support insulator 3. The fixed contact 6 of the disconnecting switch 5 is connected with a terminal member 12*b* which in turn is connected through a flexible conductor 12 to a terminal member 12*a* attached to the bus bar 4. On the other hand, attached to the support terminal 8 on the lower support insulator 9 is a terminal member 13*a* which is connected via a flexible conductor 13 to an electrical apparatus (not shown).

With the disconnecting switch 5 as constructed and arranged in the above-described manner, when the electrical apparatus is to be diconnected from the power source, one engages a hook of an electrically insulated manipulative rod (not shown) with the engagement eye 11*a* of the movable contact 11 and then pulls the upper end of the movable contact 11 rightwards as viewed in FIG. 5, whereby the movable contact 11 is disengaged from the fixed contact 6 and caused to rotate around the pivot point 11*b* in a clockwise direction in FIG. 5 toward a downwardly inclined position as illustrated by the phantom outline of the contact 11 in FIG. 5. As a result, a load-side electrical circuit constituted by the lower support terminal 8 and the flexible conductor 13 is electrically disconnected or separated from the power-source-side electrical circuit constituted by the bus bar 4 of copper wires, the flexible conductor 12 and the fixed contact 6 so that electrical equipment connected with the flexible conductor 13 is disconnected from the power source.

With the conventional disconnecting switch assembly 5 as constructed in the above-described manner, there has been a problem in that if the disconnecting switch 5 is applied to a mobile substation or a small-sized substation, the distance between the base 1 and the bus bar 4 must be decreased to a certain extent due to the dimensional restrictions required for transportation etc., so that operability and safety of the diconnecting switch are considerably impaired. In addition, there are contradictory problems in that a certain clearance is required for satisfactory manipulation of the disconnecting switch, but on the other hand, in order to minimize spacing between mutually adjacent devices disposed below the disconnecting switch assembly as much as possible for reducing the overall installation area and/or space for such devices, it is necessary to arrange the disconnecting switch assembly at a location as high as possible.

The same problems have been involved in the case of a switchgear in the form of a fuse assembly as illustrated in FIG. 6. In FIG. 6, parts or elements corresponding to those shown in FIG. 5 are identified by the same reference numerals. In this Figure, the fuse assembly, generally designated at reference numeral 5', includes a cylindrical fuse 11' containing therein a fuse element (not shown) and disposed between an upper retainer 6' attached to the distal end of an upper support insulator 7 and a lower retainer 8' attached to the distal end of a lower support insulator 9. The cylindrical fuse 11' having an engagement eye 11*a'* is releasably engageable at its upper end with the upper retainer 6' and at its lower end with the lower retainer 8'. The lower end of the cylindrical fuse 11' is pivoted to the lower retainer 8' for rotary movement on a vertical plane. With this arrangement, when excessive current flows from the bus bar 4 to the electrical apparatus connected with the flexible conductor 13, the fuse element (not shown) in the cylindrical fuse 11' is blown out so that the electrical apparatus is disconnected from the power source. In this case, one engages a hook of an electrically insulated manipulative rod (not shown) with the engagement eye 11*a* of the fuse 11' and then pulls the upper end of the fuse 11' rightwards as viewed in FIG. 6, whereby the fuse 11' is disengaged from the upper retainer 6' and caused to rotate around the pivot point 11*b'* in a clockwise direction as illustrated by the broken line in FIG. 6. As a result, a load-side electrical circuit constituted by the lower bracker 8' and the flexible conductor 13 is electrically disconnected or separated from the power-source-side electrical circuit constituted by the bus bar 4 of copper wires, the flexible conductor 12 and the upper retainer 6' so that the electrical apparatus connected with the flexible conductor 13 is disconnected from the power source. Thereafter, the load-side electrical circuit is checked and the failed fuse 11' is replaced with a new one.

SUMMARY OF THE INVENTION

In view of the above, the present invention is intended to obviate the above-mentioned problems of the prior art, and has for its object the provision of a switchgear assembly which offers improved operability of the switchgear to a practical extent, and which reduces not only installation area or space for various devices to be disposed below the switchgear but also the weight of the switchgear as much as possible.

In order to achieve the above objects, according to one aspect of the present invention, there is provided a disconnecting switch assembly for an electrical apparatus wherein a bus bar is supported on the top of a vertically disposed pole through a first support insulator, the disconnecting switch assembly comprising a fixed contact attached to the bus bar, and a movable contact pivoted at its one end to a second support insulator for rotary motion on a vertical plane, the second support insulator being fixedly mounted on the pole at a location near the top end thereof, the movable contact being adapted to be releasably engageable at its other end with the fixed contact and connected at its one end through a conductor with an electrical apparatus.

The second support insulator is provided with a support terminal to which the one end of the movable contact is pivoted.

Preferably, the second support insulator is mounted on the pole at right angle relative thereto.

In accordance with a preferred embodiment, the fixed contact is supported on the bus bar through a fastening member.

Alternatively, the fixed contact comprises the bus bar with which the other end of the movable contact is directly engageable.

In accordance with another aspect of the present invention, there is provided a fuse assembly for an electrical apparatus wherein a bus bar is supported on the top end of a vertically disposed pole through a first support insulator, the fuse assembly comprising a first retainer attached to the bus bar, a second support insulator fixedly mounted on the pole at a location below and vertically spaced apart from the first retainer, a second retainer attached to the second support insulator and adapted to be connected through a conductor with an electrical apparatus, and a cylindrical fuse adapted to be releasably engageable at its one end with the first retainer and at its other end with the second retainer, the fuse being pivotally supported at its other end on the second retainer for rotary motion on a vertical plane.

Preferably, the second support insulator is mounted on the pole at right angles relative thereto.

In accordance with an embodiment of the present invention, the first bracket is supported on the bus bar through a support member.

Alternatively, the first bracket comprises the bus bar with which the other end of the fuse is directly engageable.

The above and other objects, features and advantages of the present invention will become apparent from the following detailed description of a few presently preferred embodiments of the invention when taken in conjunction with the accompanying drawings.

DESCRIPTION OF THE PREFERRED EMBODIMENTS

Figure 1:
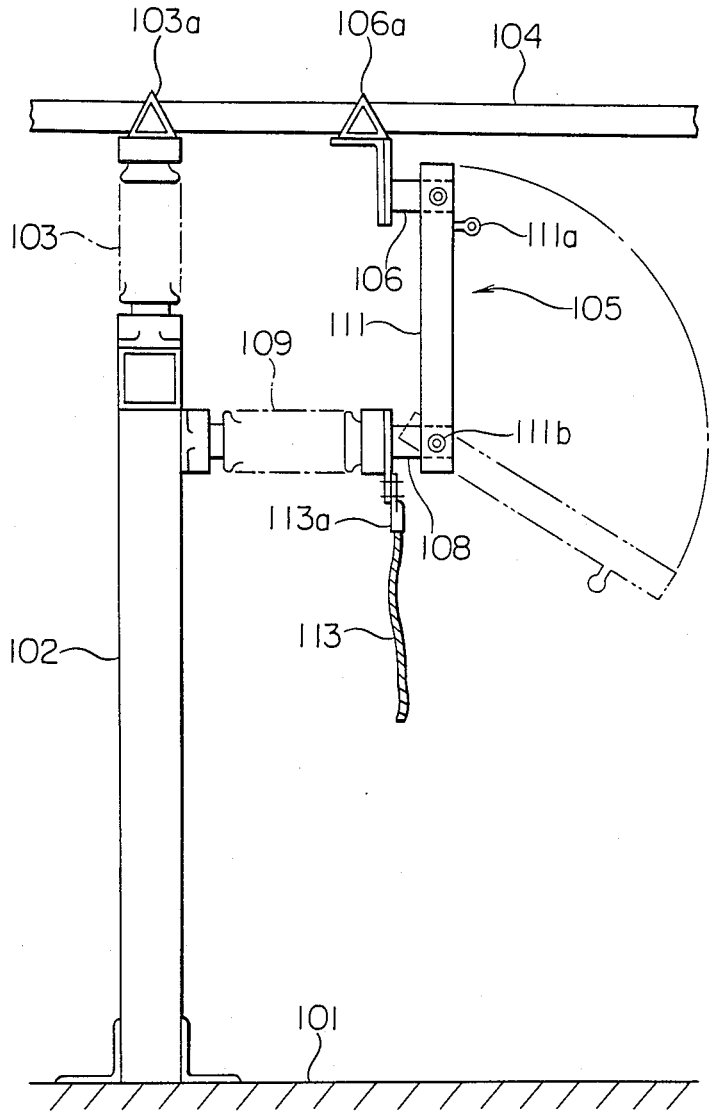
FIG. 1 is a side elevational view showing a disconnecting switch constructed in accordance with a preferred embodiment of the present invention.

FIG. 1 shows a switchgear in the form of a disconnecting switch assembly constructed in accordance with the principles of the present invention. In FIG. 1, the disconnecting switch assembly, generally designated at reference numeral 105, is mounted on a vertical pole 102 fixed at its base end to a base 101. Fixedly attached on the top end of the pole 101 is a first support insulator 103 on which a bus bar 104 of copper wires is supported through a fastening member 103*a*. In this manner, the bus bar 104 is supported through the first support insulator 103 on the pole 102 at right angles relative thereto. A second support insulator 109 is fixedly mounted at its base end on the vertical pole 102 near the upper end thereof horizontally or at right angles relative to the first support insulator 103 and hence the pole 102 with a support terminal 108 firmly attached to the distal end of the second support insulator 109. The support terminal 108 has a connecting terminal 113*a* which is in turn connected with a flexible conductor 113 leading to an electrical apparatus (not shown).

The disconnecting switch assembly 105 comprises a fixed contact 106 attached to the bus bar 104 through a fastening member 106*a*, and a movable contact 111 pivoted at 111*b* to the support terminal 108 on the second support insulator 109 for rotary motion on a vertical plane. The movable contact 111 is rotatable around its pivot point 111*b* so as to take an upright position as illustrated by the solid outline of the movable contact 111 in FIG. 1, in which the upper end of the movable contact 111 is releasably engageable with the fixed contact 106.

Figure 5:
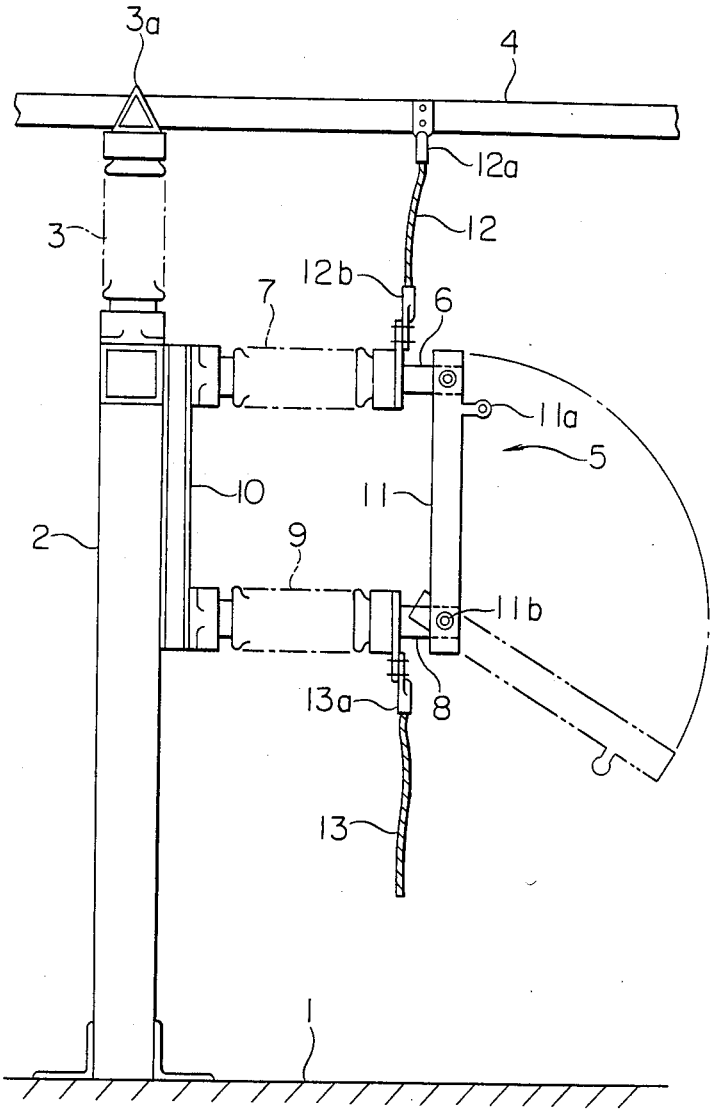
FIG. 5 PRIOR ART
FIG. 5 is a side elevational view showing a prior art disconnecting switch.

The disconnecting switch 105 of the present invention as constructed in the above-described manner operates in the same manner as in the prior art disconnecting switch assembly 5 shown in FIG. 5, without requiring any other particular or additional manipulation.

Here, it is to be noted that if the distance between the base 101 and the bus bar 104 remains the same as in the prior art disconnecting switch 5 as shown in FIG. 5, it is possible to position the second support insulator 109 at a location near the top end of the pole 102, in place of the upper support insulator 7 of the prior art shown in Fig. 5, so that the distance between the second support insulator 109 and the base 101 is increased by the distance between the upper and lower support insulators 7 and 9 of FIG. 5, thus substantially improving operability of the disconnecting switch assembly 105 as well as increasing the installation area or space available for adjacent devices to be arranged below the disconnecting switch assembly 105.

Figure 2:
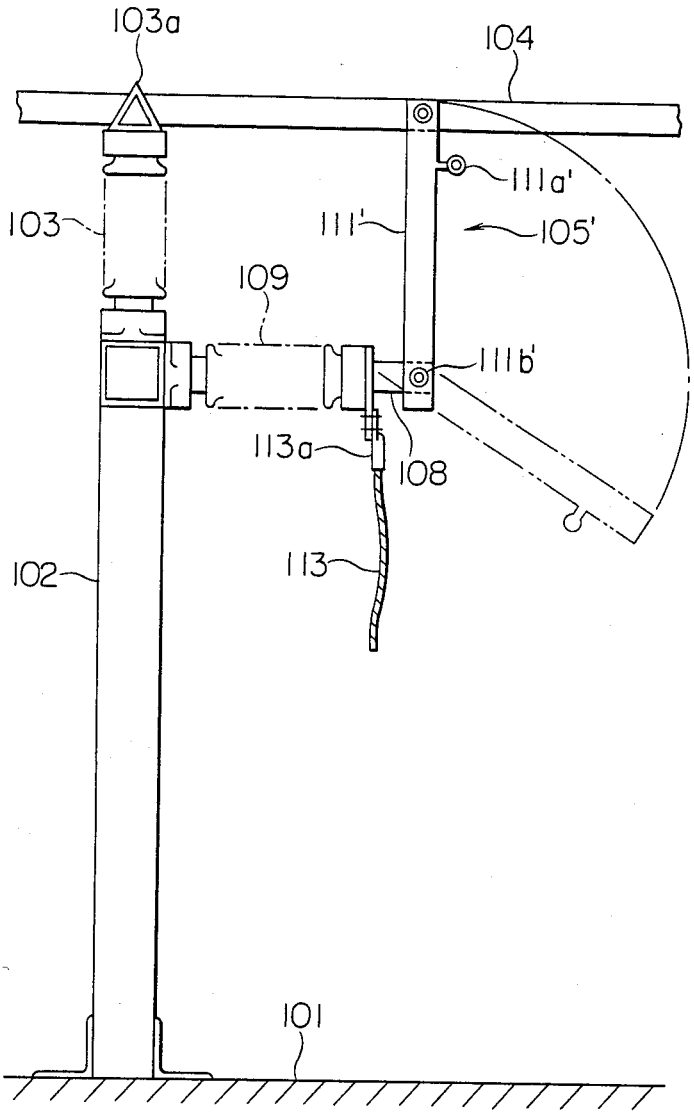
FIG. 2 is a side elevational view showing a modified form of a disconnecting switch in accordance with the present invention.

FIG. 2 shows a modified form of a disconnecting switch assembly 105' in accordance with the present invention. In this modification, the fixed contact 106 and the fastening member 106*a* of the aforementioned embodiment shown in FIG. 1 are omitted and the upper end of the movable contact 111' is directly engageable with the bus bar 104. The construction, arrangement and operation of this modification other than the above are the same as those of the disconnecting switch 105 of FIG. 1.

Figure 3:
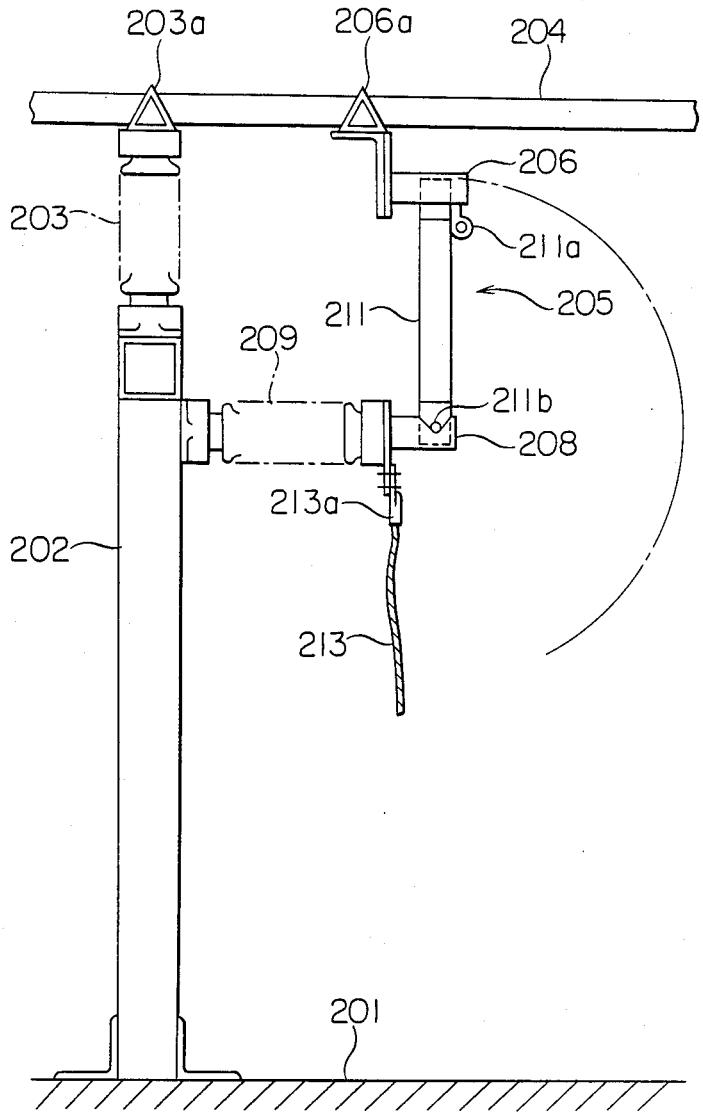
FIG. 3 is a side elevational view showing a fuse assembly constructed in accordance with another preferred embodiment of the present invention.

FIG. 3 shows a switchgear in the form of a fuse assembly constructed in accordance with the present invention. As seen from this figure, similar to FIG. 1, a bus bar 204 is supported through a first support insulator 203 and a fastening member 203*a* on a vertical pole 202 fixed on a base 201, and a second support insulator 209 is fixedly mounted on the pole 202.

The fuse assembly, generally designated at reference numeral 205, comprises an upper bracket 206 attached to the bus bar 204 through a fastening member 206*a*, a lower bracket 208 fixedly attached to the distal end of the second support insulator 209, and a cylindrical fuse 211 containing therein a fuse element (not shown) and adapted to be releasably engaged at its upper end with the upper bracket 206 and at its lower end with the lower bracket 208, the lower end of the cylindrical fuse 211 being pivotally supported to the lower bracket 208 for rotary motion on a vertical plane.

Figure 6:
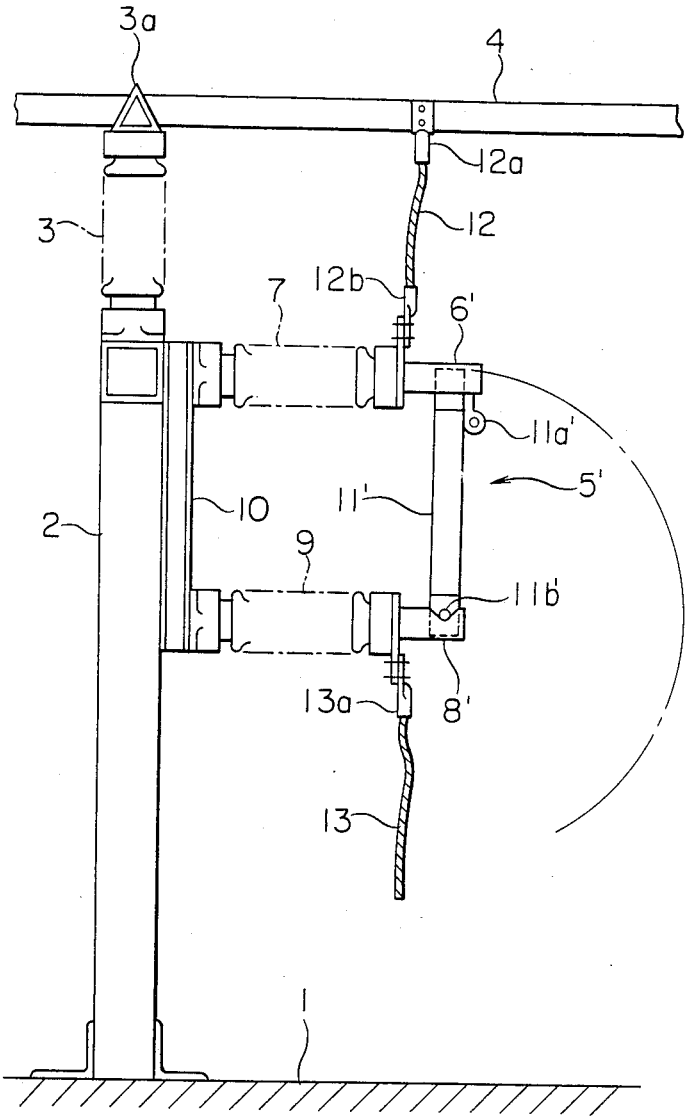
FIG. 6 PRIOR ART
FIG. 6 is a side elevational view showing a prior art fuse assembly.

The fuse assembly 205 of the present invention as constructed in the above-described manner operates in the same manner as in the prior art fuse assembly 5' shown in FIG. 6, without requiring any other particular or additional manipulation.

Here, it is to be noted that if the distance between the base 201 and the bus bar 204 remains the same as in the prior art fuse assembly 5' as shown in FIG. 6, it is possible to position the second support insulator 209 at a location near the top end of the pole 202, in place of the upper support insulator 7 shown in FIG. 6, so that the distance between the second support insulator 209 and the base 201 is increased by the distance between the upper and lower support insulators 7 and 8 of FIG. 6, thus substantially improving operability of the fuse assembly 205 as well as increasing the installation area or space for adjacent devices to be arranged below the fuse assembly 205.

Figure 4:
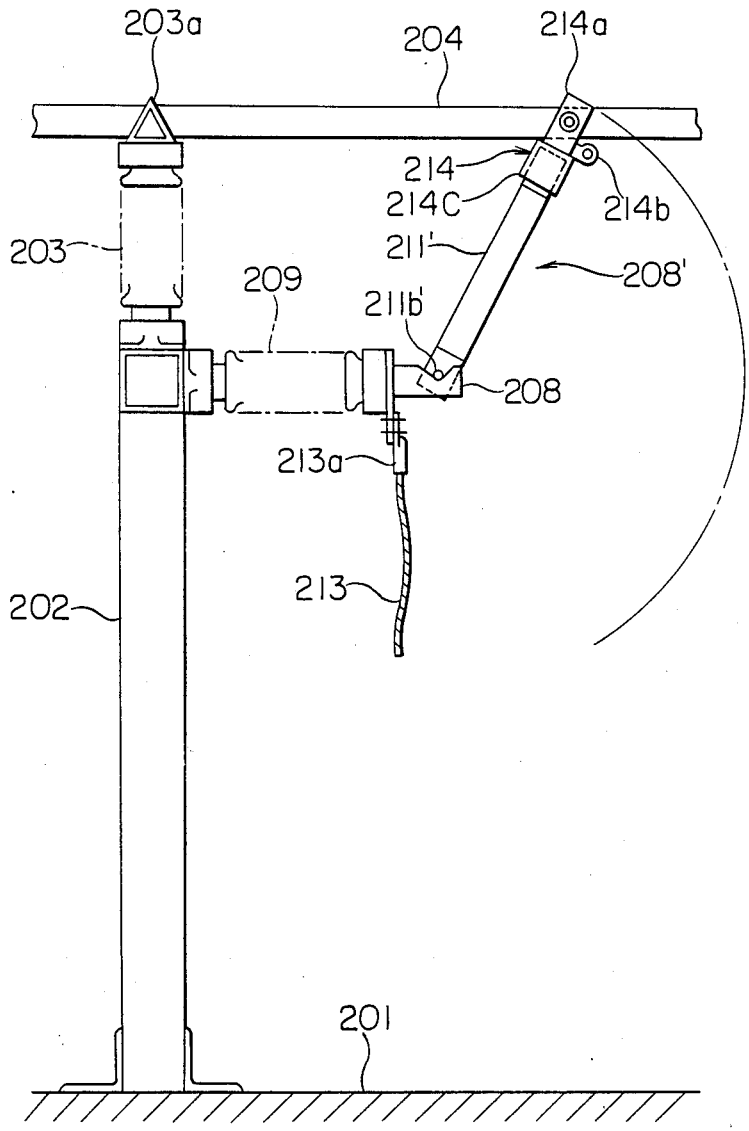
FIG. 4 is a side elevational view showing a modified form of a fuse assembly in accordance with the present invention.

FIG. 4 shows a modified form of a fuse assembly 208' in accordance with the present invention. In this modification, the upper bracket 206 and the fastening member 206*a* of the aforementioned embodiment shown in FIG. 3 are omitted and the top 214*a* of the retainer 214 at the upper end of the cylindrical fuse 211' is directly engageable with the bus bar 204, the retainer 214 having an eye 214*b* for engagement by a hook to pull the fuse clockwise, as illustrated by the broken line. The construction, arrangement and operation of this modification other than the above are the same as those of the fuse assembly 208 of FIG. 3.

What is claimed is:

1. A switchgear assembly for connecting and disconnecting electrical power from a source to an electrical apparatus comprising:

a bus bar for carrying electrical power from the source;

a vertical pole carrying a first vertical support insulator for supporting said bus bar and a second horizontal support insulator;

a movable contact having an upper end and a lower end;

means solely connected to said bus bar and completely independent of said pole for holding the upper end of said movable contact connected to and in fixed position on said bus bar; and means on said second support insulator mounted on said pole pivotally supporting the lower end of said movable contact for rotary motion in a vertical plane from a release position where the upper end of said movable contact is physically and electrically disconnected from said bus bar and a connected position where the upper end of said movable contact is held by said holding means connected to and in fixed position on said bus bar.

2. A switchgear assembly according to claim 1 wherein said second support insulator is provided with a support terminal to which the lower end of said movable contact is pivoted.

3. A switchgear assembly according to claim 2 wherein said second support insulator is mounted on said pole at right angles relative thereto.

4. A switchgear assembly according to claim 1 wherein said holding means includes a fixed contact engageable by the upper end of said movable contact and supported on said bus bar solely through a fastening member.

5. A switchgear assembly according to claim 1 wherein the upper end of said movable contact is directly engageable with said bus bar.

6. A switchgear assembly according to claim 1 wherein said movable contact comprises a fuse and first and second retainers at opposite ends of said fuse, the first retainer at one end of said fuse providing the upper end of said movable contact, the second retainer at the other end of said fuse providing the lower end of said movable contact, said holding means holding the first retainer connected to and in fixed position on said bus bar.

7. A switchgear assembly according to claim 6 wherein said second support insulator is mounted on said pole at right angles relative thereto.

8. A switchgear assembly according to claim 6 wherein said first retainer is supported on said bus bar by said holding means including a fastening member.

9. A switchgear assembly according to claim 6 wherein said first retainer is mounted directly on said bus bar by said holding means.

* * * * *